US009205314B1

(12) United States Patent
Gagnon

(10) Patent No.: US 9,205,314 B1
(45) Date of Patent: Dec. 8, 2015

(54) SYSTEM FOR A PLAYER TO PLAY GOLF

(71) Applicant: Carl Robert Gagnon, Castro Valley, CA (US)

(72) Inventor: Carl Robert Gagnon, Castro Valley, CA (US)

( * ) Notice: Subject to any disclaimer, the term of this patent is extended or adjusted under 35 U.S.C. 154(b) by 482 days.

(21) Appl. No.: 13/768,554

(22) Filed: Feb. 15, 2013

Related U.S. Application Data

(63) Continuation-in-part of application No. 12/804,219, filed on Jul. 17, 2010, now Pat. No. 8,409,027.

(51) Int. Cl.
*A63B 69/36* (2006.01)
*A63B 57/00* (2015.01)

(52) U.S. Cl.
CPC ..... *A63B 57/00* (2013.01)

(58) Field of Classification Search
CPC ..... A63B 69/36; A63B 69/3608
USPC ..... 473/266–268, 278, 405
See application file for complete search history.

(56) References Cited

U.S. PATENT DOCUMENTS

| | | | | | |
|---|---|---|---|---|---|
| 1,596,110 | A * | 8/1926 | Lynch | 473/218 |
| 3,542,369 | A * | 11/1970 | Anderson | 473/257 |
| 3,561,764 | A * | 2/1971 | Thomas | 473/257 |
| 3,992,011 | A * | 11/1976 | Jessee | 473/268 |
| 5,067,719 | A * | 11/1991 | Mook | 473/200 |
| 5,645,494 | A * | 7/1997 | Dionne et al. | 473/278 |
| 6,569,026 | B1 * | 5/2003 | Weis | 473/139 |
| 6,769,999 | B1 * | 8/2004 | Chase | 473/386 |
| 7,131,910 | B2 * | 11/2006 | Townsend, II | 473/278 |
| 7,527,562 | B1 * | 5/2009 | Mason | 473/257 |
| 8,409,027 | B1 * | 4/2013 | Gagnon | 473/278 |
| 2003/0130055 | A1 * | 7/2003 | Townsend, II | 473/278 |
| 2003/0190972 | A1 * | 10/2003 | Townsend, II | 473/278 |
| 2005/0250592 | A1 * | 11/2005 | Roach | 473/268 |
| 2010/0130299 | A1 * | 5/2010 | Womersley et al. | 473/268 |

OTHER PUBLICATIONS

Website www.afterimagetech.com/home Put Online Jul. 2007 (See Attached 14 Pages).
Portion of a Paper By R.H. Brian Costello, 2006 (See Attached Two Pages).

* cited by examiner

*Primary Examiner* — Raleigh W Chiu
(74) *Attorney, Agent, or Firm* — Ted Masters

(57) ABSTRACT

A system for a player to play golf includes a member having a surface. A colored area is disposed on the surface of the member, the colored area is yellow which when stared at will produce a violet afterimage. The member or a printed representation thereof is placed on and article of wearing apparel worn by the player so that the player can see the colored area. Prior to hitting a golf ball, the player stares at the colored area for a few seconds, closes his/her eyes and sees the violet afterimage, then opens his/her eyes. The player then hits the golf ball.

14 Claims, 13 Drawing Sheets

SYSTEM FOR A PLAYER TO PLAY GOLF

CROSS REFERENCE TO RELATED APPLICATION

This application is a Continuation-In-Part of and claims the filing benefit under 35 U.S.C. §120 of application Ser. No. 12/804,219, filed Jul. 17, 2010, which is hereby incorporated by reference.

TECHNICAL FIELD

The present invention pertains generally to the game of golf, and more particularly to a system for improving a player's golf game.

BACKGROUND OF THE INVENTION

Visual afterimages are well known in the art. If a person stares at a first color (red for example) for a period of time, and then looks at a second surface (e.g. white), an afterimage of the complementary color (in this case cyan) of the first color will appear. Research in neuropsychology has shown that viewing afterimages can slow down brain waves, resulting in numerous positive health benefits. Additional research has shown that by staring at a yellow color, a violet afterimage will be produced. When the yellow color is viewed for a few minutes a day, over a period of 3 to 4 weeks, it caused the viewer to produce alpha brain waves. Alpha brain waves (3 Hz-12 Hz) are much slower than normal waking 'beta' brain waves, and create a feeling of well-being and increased focus. These brain wave functions characterize optimal performance or what is sometimes referred to as being in "The Zone." The state produced by alpha brain waves is characterized by extreme relaxation and blissful pleasure, reduced stress, a slowing of physiological functions, sharpened focus, flowing movement and spontaneity. It has further been found that alpha brain waves, reduce pain, depression, stress and blood pressure, and results in other positive health results.

BRIEF SUMMARY OF THE INVENTION

The present invention is directed to a system which applies the afterimage principle to the game of golf. The system quiets the player's mind, and enables the player to significantly improve his/her performance. It does so by providing levels of mental relaxation that otherwise can only be achieved by years of training, practice, and experience. The present invention enables the player to slow down his/her brain waves enabling them to reach "The Zone" and improve their overall golf game.

In one embodiment, the system includes a member (typically a white sheet) which has a yellow colored area which will produce a violet afterimage. The member is placed on an article of wearing apparel so that it is visible by the player. In another embodiment the yellow area is directly disposed (such as by printing) upon the article of wearing apparel.

In accordance with an embodiment, a system for a player to play golf includes a member having a surface. A colored area is disposed on the surface of the member, the colored area being yellow. A second area is disposed on the surface of the member around the colored area. An article of wearing apparel is worn by the player. The member is disposable on the article of wearing apparel so that the yellow colored area is visible to the player.

In accordance with another embodiment, the system cooperates with a playing area which includes a golf ball and a golf tee having a shank. The system further includes a hole disposed in the second area, the hole for receiving the shank of the golf tee. The member is disposable on the article of wearing apparel so that the hole is disposed between the colored area and the playing area.

In accordance with another embodiment, the yellow has a wavelength of about 550 nanometers which produces a violet afterimage having a wavelength of about 400 nanometers.

In accordance with another embodiment, the second area is white and completely surrounds the colored area.

In accordance with another embodiment, the member is disk shaped, the second area is circular, and the colored area is circular and centered within the second area.

In accordance with another embodiment, a connector connects the member to the article of wearing apparel.

In accordance with another embodiment, the member has a second surface opposite the surface. An adhesive is disposed on the second surface, the adhesive for connecting the member to the article of wearing apparel.

In accordance with another embodiment, the article of wearing apparel is a shoe having a vamp. The member is disposable on the shoe so that the member resides colored area up on the vamp of the shoe.

In accordance with another embodiment, the article of wearing apparel is a shirt or a glove.

In accordance with another embodiment, the member is sized so that it will fit upon the article of wearing apparel.

In accordance with another embodiment, a system for a player to play golf includes, the system cooperating with a playing area which includes a golf ball and a golf tee having a shank. The system further includes an article of wearing apparel worn by the player. A colored area is disposed on the article of wearing apparel so that the colored area is visible to the player, the colored area being yellow. A second area is disposed around the colored area. A circle is disposed in the second area, the circle representing a hole for receiving the shank of the golf tee.

In accordance with another embodiment, the colored area and the circle are disposed so that the circle is disposed between the colored area and the playing area.

In accordance with another embodiment, a dark border is disposed around the second area.

Other embodiments, in addition to the possible embodiments enumerated above, will become apparent from the following detailed description, taken in conjunction with the accompanying drawings, which illustrate, by way of example, the principles of the system.

DETAILED DESCRIPTION OF THE INVENTION

Figure 1:
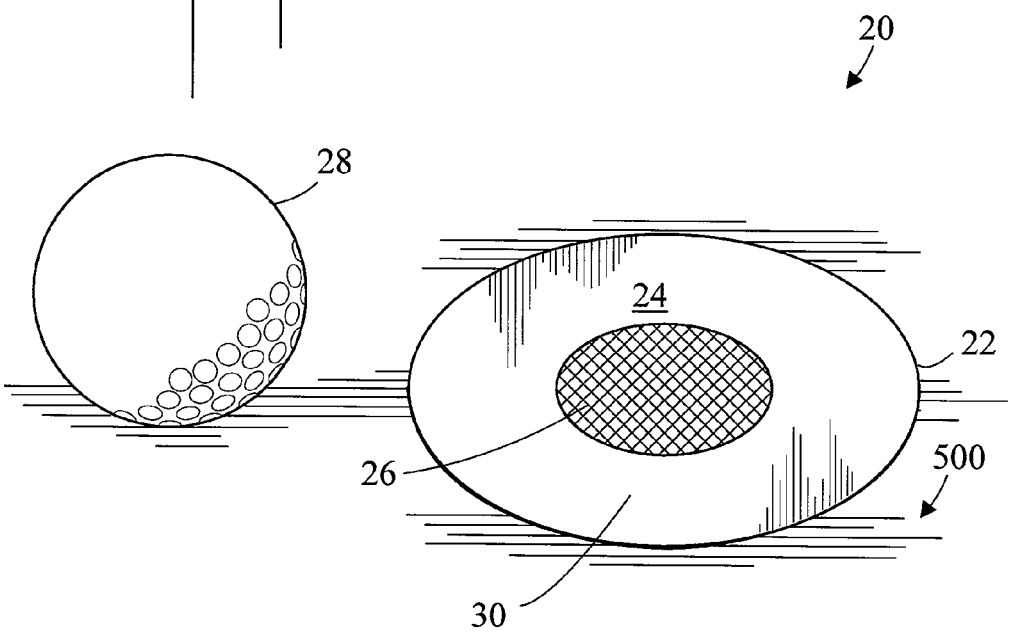
FIG. 1 is a perspective view of a system for playing golf.
Figure 2:
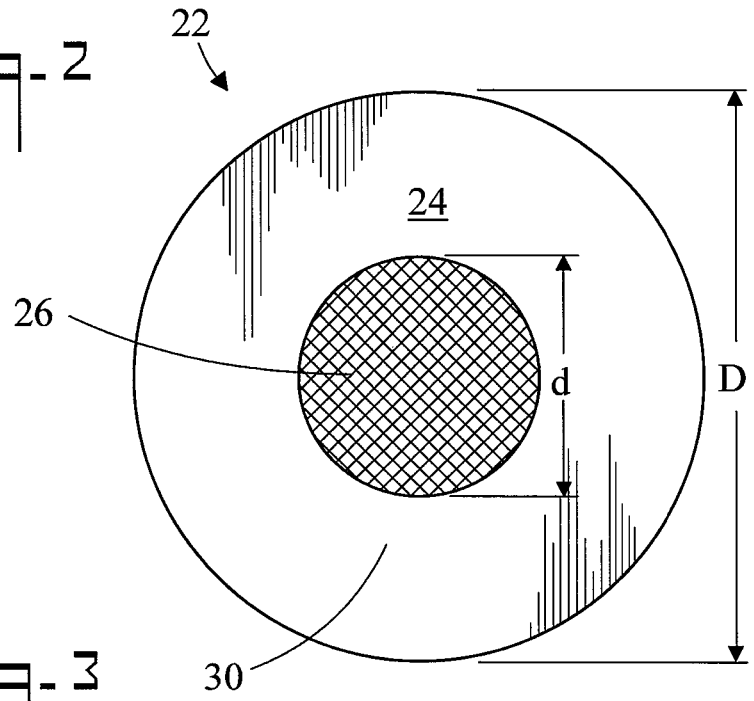
FIG. 2 is a top plan view of a member having a surface.
Figure 3:
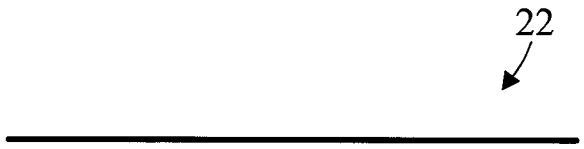
FIG. 3 is a side elevation view of the member.
Figure 4:
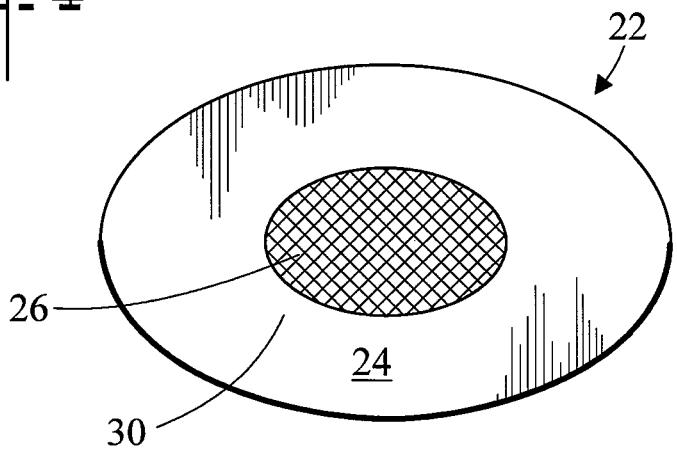
FIG. 4 is a perspective view of the member.

Referring initially to FIG. 1, there is illustrated a system for a player to play golf, generally designated as 20. System 20 includes a member 22 which is also illustrated in FIGS. 2-4. Member 22 has a surface 24. A colored area 26 is disposed on surface 24 of member 22. In an embodiment, colored area 26 is yellow which when stared at will produce a violet afterimage. In another embodiment, the yellow color has a wavelength of about 550 nanometers (greenish yellow); and the violet afterimage will have a wavelength of about 400 nanometers. In another embodiment, colored area 26 is a fluorescent yellow such as is available in a marking pen (highlighter) from a stationary store. System 20 further includes a golf ball 28 which is positionable so that the player can view both golf ball 28 and colored area 26 of member 22. In the shown embodiment, both member 22 and golf ball 28 are placed on a support surface 500 (such as grass, soil, turf, artificial turf, a pad, a mat, or the like).

In the shown embodiment, member 22 is a disc shaped sheet made from paper, cardboard or the like, and has a diameter D of about three inches. In the shown embodiment colored area 26 is circular and has a diameter d of about 1.25 inches, but could be other shapes or sizes. Colored area 26 is surrounded by a donut-shaped second area 30 which is also disposed on surface 24 of member 22. In an embodiment, second area 30 is white.

Figure 5:
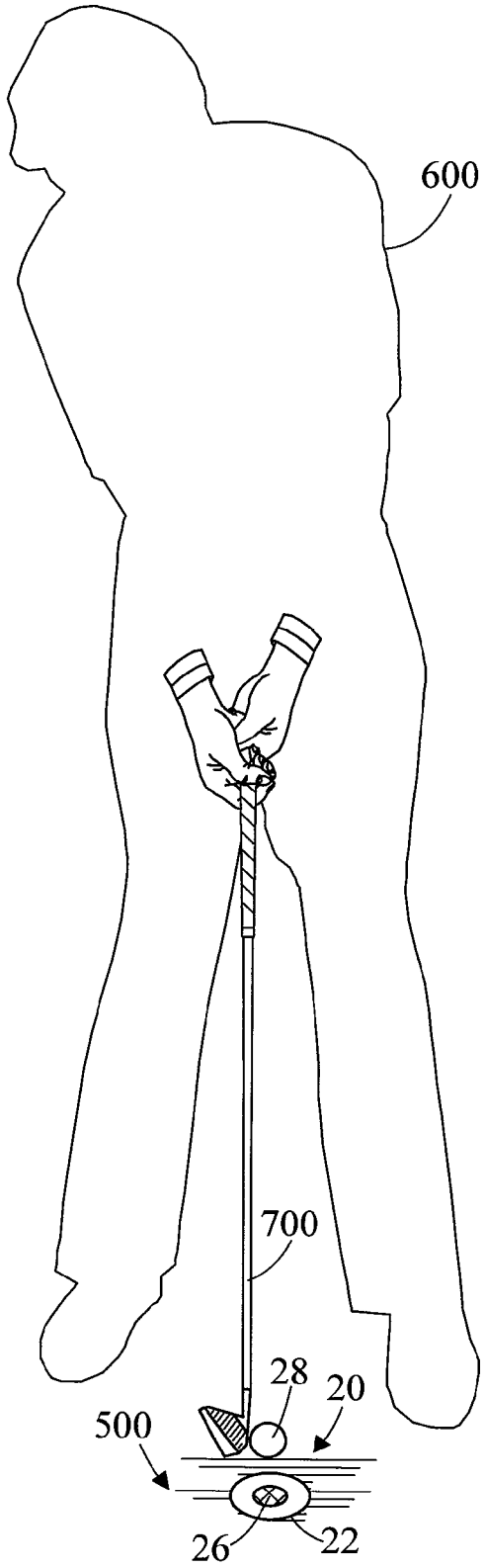
FIG. 5 is a reduced front elevation view of a player using the system.

FIG. 5 is a reduced front elevation view of a player 600 using system 20. Member 22 and golf ball 28 have been placed upon support surface 500. Player 600 stares at colored area 26 for a few seconds (e.g. 3-5 seconds) and then uses golf club 700 to hit golf ball 28. (also refer to the following method of use).

In terms of using embodiment 20, a method for a player 600 to play golf includes (refer to FIGS. 1-5 and the associated discussions)

(a) providing a support surface 500;

(b) providing a golf club 700;

(c) providing a system 20 for playing golf including;

a member 22 having a surface 24;

a colored area 26 disposed on surface 24 of member 22, colored area 26 being yellow;

a golf ball 28 which is positionable upon support surface 500;

(d) placing golf ball 28 and member 22 upon support surface 500 so that player 600 can view both golf ball 28 and colored area 26;

(e) player 600 staring at colored area 26 for a few seconds;

(f) after step (e), player 600 closing his or her eyes and seeing a violet afterimage; and, (g) player 600 opening his or her eyes and using golf club 700 to hit golf ball 28.

The method further including:

in step (c) member 22 being disk shaped.

The method further including:

in step (c), said yellow having a wavelength of about 550 nanometers; and, in step (f), said violet afterimage having a wavelength of about 400 nanometers.

The method further including:

in step (c), colored area 26 being a fluorescent yellow.

The method further including:

prior to step (f), player 600 conditioning his/her vision by staring at said colored area for a short period of time every day for a few weeks (see discussion below). It is noted that the player can use a member 22 other than the one used during a round of golf to effect the visual conditioning.

Visual Conditioning:

To prepare for using the method and system, the player practices daily, for about 5 minutes, for 3 to 4 weeks, enabling the player to begin to see a violet (about 400 nanometer) afterimage. After a short amount of visual conditioning (perhaps the first use), the player, with his/her eyes closed, will see a violet afterimage. As the player continues to have his/her eyes closed and see the violet afterimage, the player's brain waves begin to slow down. Approximately ⅔'s of the brain is used for visual processing. Focusing on the violet 400 nanometer afterimage causes the brain to synchronize between 3 Hz and 12 Hz—alpha frequency. Between 3 and 4 weeks of use, for a few minutes per day, the player will experience the alpha state—a very blissful, relaxed feeling.

After the above visual conditioning, before a golf shot the player places member 22 colored area 26 up on the ground near their golf ball. If teeing off, the player places the tee through the tee hole in the member. The player then stares at the colored area 26, takes a deep breath, closes his/her eyes, sees the violet afterimage, exhales, open his/her eyes and swings the golf club at the golf ball. This process takes just a few seconds.

Figure 6:
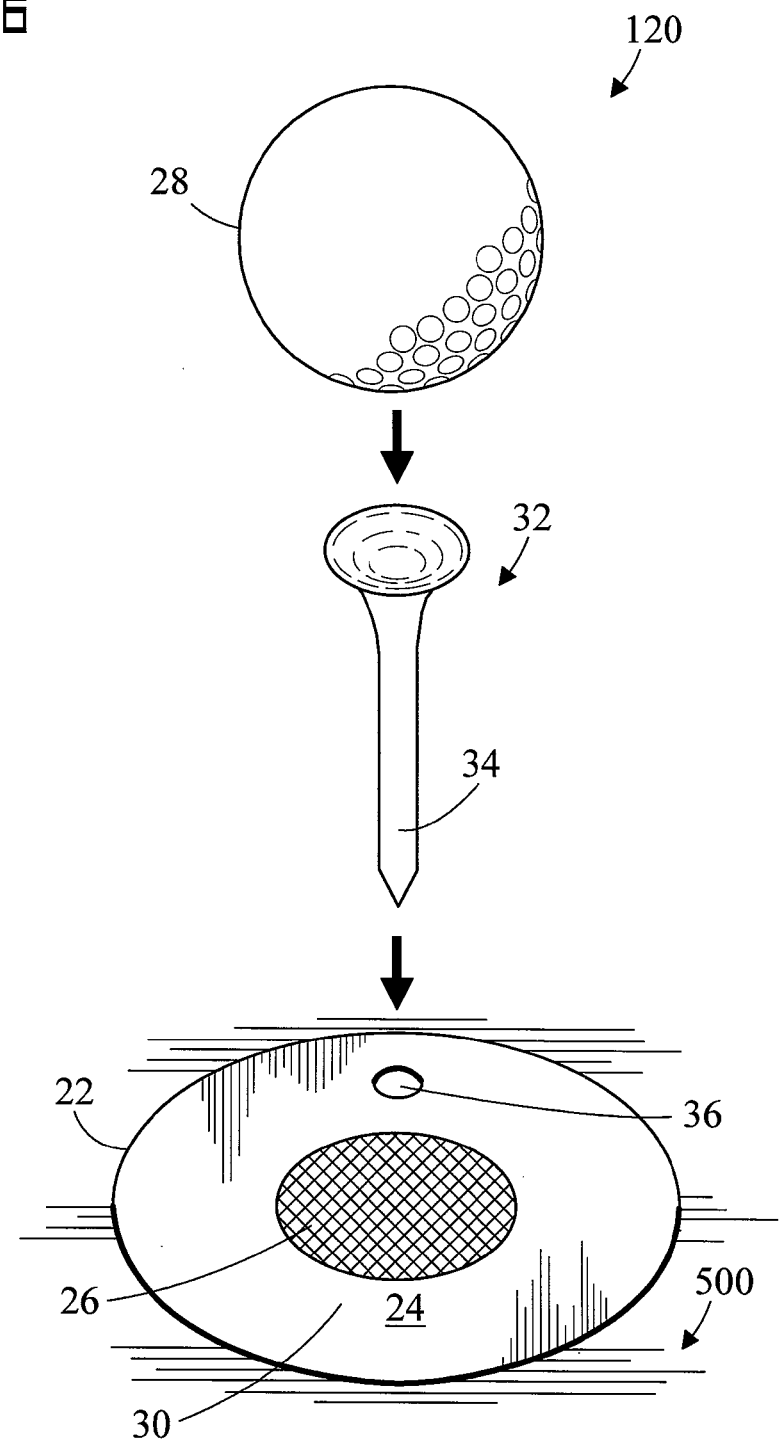
FIG. 6 is an exploded perspective view of a second embodiment of the system.
Figure 7:
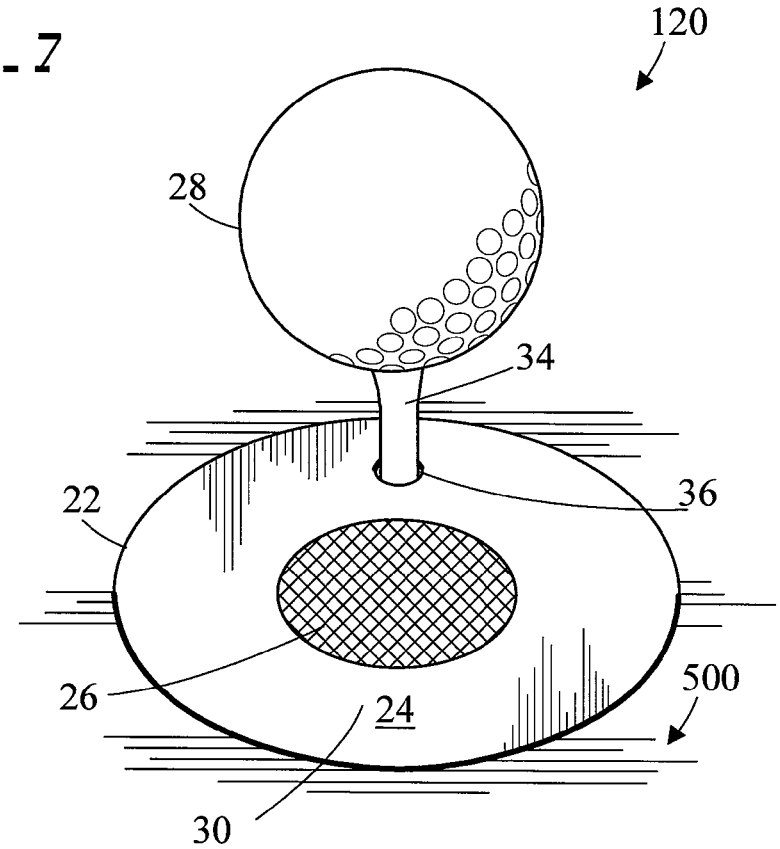
FIG. 7 is a perspective view of the second embodiment.
Figure 8:
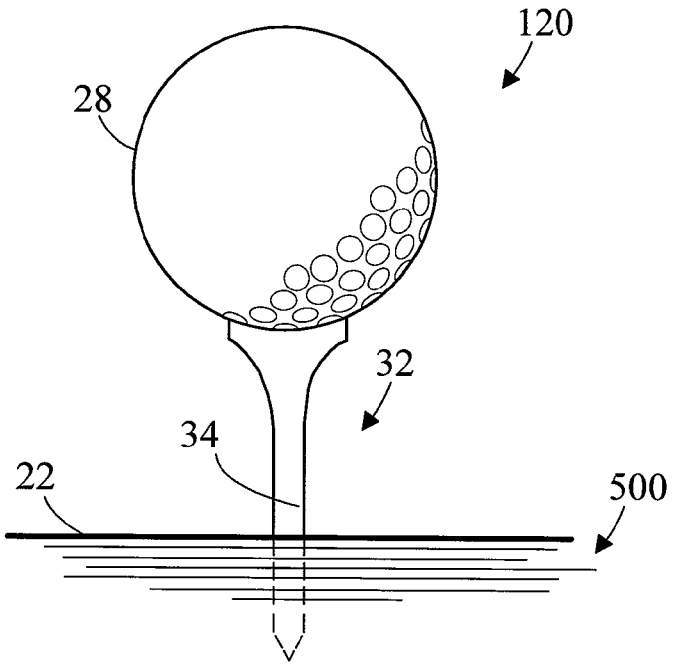
FIG. 8 is a side elevation view of the second embodiment.

FIG. 6-8 are exploded perspective, perspective, and side elevation views respectively of a second embodiment, generally designated as 120. Embodiment 120 is similar to embodiment 20 and includes member 22 having surface 24, colored area 26, golf ball 28, and second area 30. Embodiment further includes a golf tee 32 which has a shank 34, and a hole 36 disposed in second area 30 of member 22. Hole 36 is shaped and dimensioned to closely receive shank 34 of golf tee 32. Shank 34 of golf tee 32 is placed through hole 36 of member 22, and shank 34 is inserted into support surface 500.

Figure 9:
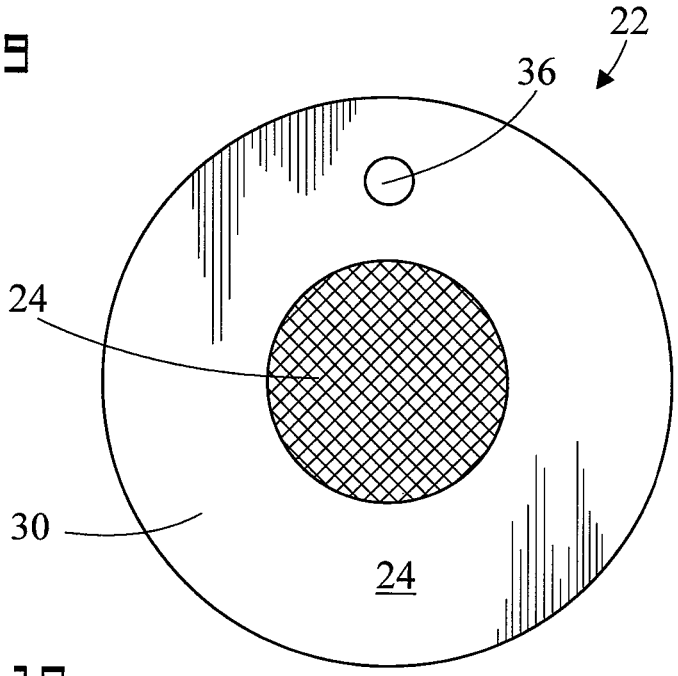
FIG. 9 is a top plan view a second embodiment of the member.
Figure 10:
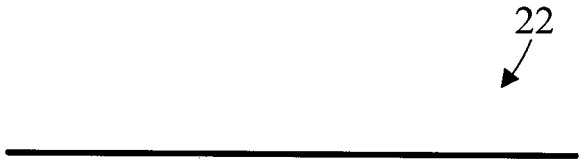
FIG. 10 is a side elevation view of the second embodiment member.
Figure 11:
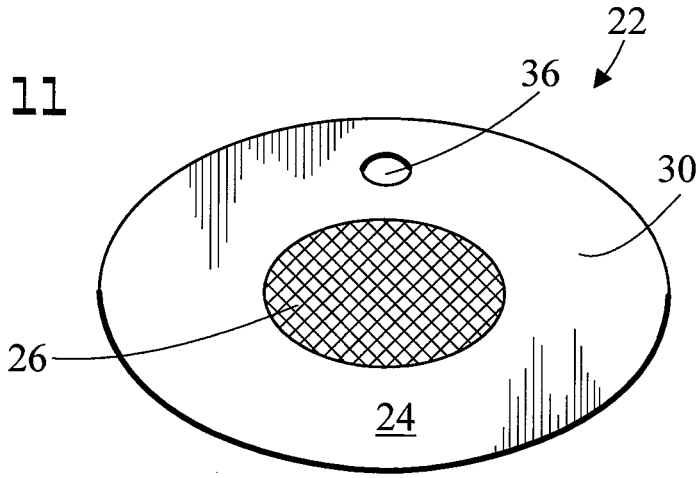
FIG. 11 is a perspective view of the second embodiment member.

FIGS. 9-11 are top plan, side elevation, and perspective views respectively of member 22, surface 24, colored area 26, second area 30, and hole 36.

Figure 12:
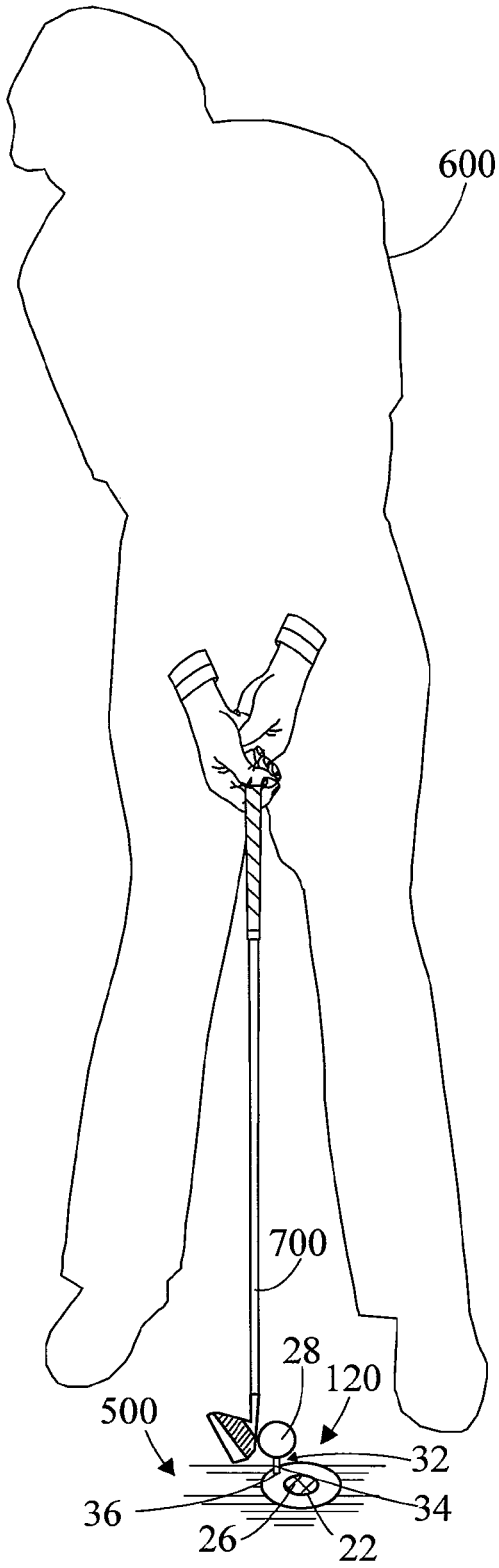
FIG. 12 is a reduced front elevation view of a player using the second embodiment of the system.

FIG. 12 is a reduced front elevation view of player 600 using second embodiment 120. Member 22 has been placed upon support surface 500, shank 34 of golf tee 32 is placed through hole 36 in member 22, and golf ball 28 is placed upon golf tee 32. Player 600 stares at colored area 26 for a few seconds (e.g. 3-5 seconds) and then uses golf club 700 to hit golf ball 28. (also refer to the following method of use). Using embodiment 120 is similar to that of embodiment 20 discussed above, with the exception that player 600 places shank 34 of golf tee 32 through hole 36 in member 22, then inserts shank 34 into support surface 500, and then places golf ball 28 on golf tee 32. Moreover, it is noted that in step (d) the term "placing golf ball 28 upon support surface 500" is intended to include indirect placement upon intervening golf tee 32, which is inserted into support surface 500.

Figure 13:
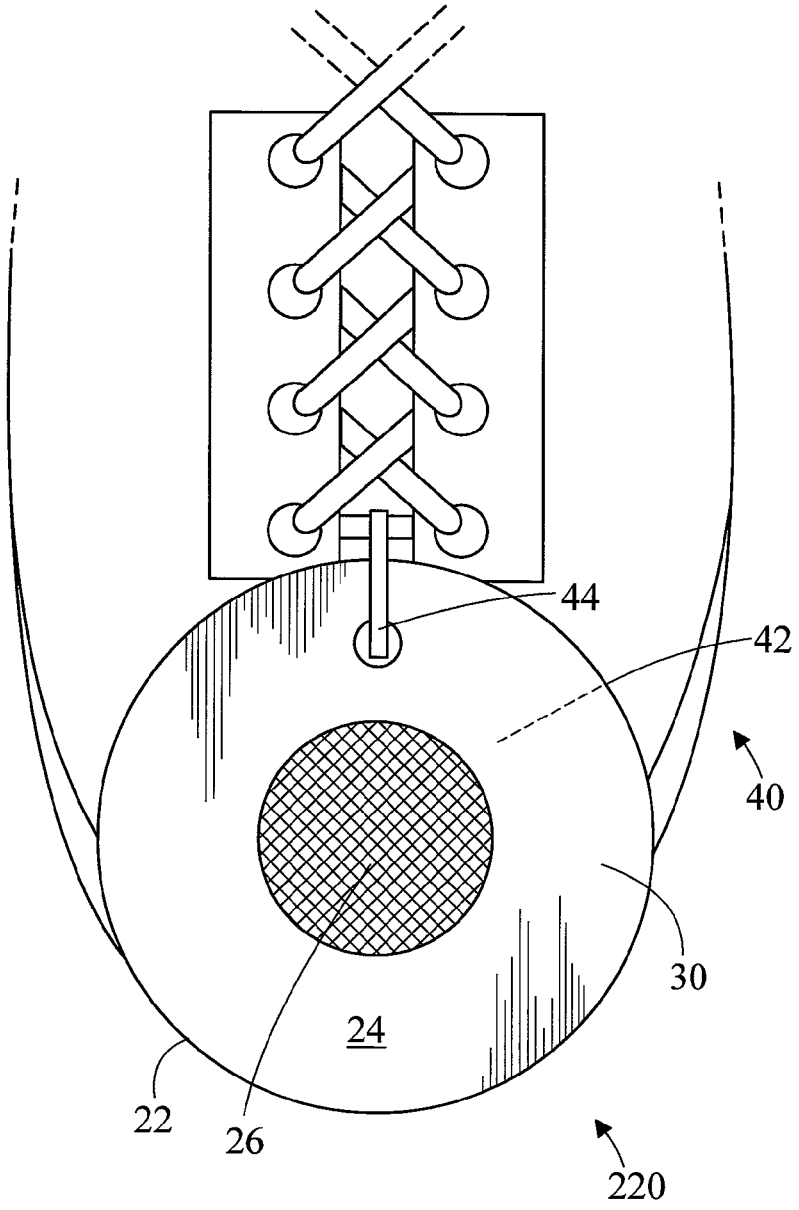
FIG. 13 is a top plan view of a third embodiment of the system.

FIG. 13 is a top plan view of a third embodiment, generally designated as 220. As with embodiments 20 and 120, embodiment 220 includes member 22 having surface 24, and colored area 26 which will produce a violet afterimage of about 400 nanometers, and second area 30. The system of embodiment 220 also includes an article of wearing apparel 40 which is worn by player 600 (also refer to FIGS. 14 and 15). Member 22 is disposable on article of wearing apparel 40 so that colored area 26 is visible to player 600. In the shown embodiment, article of wearing apparel 40 is shoe which has a vamp 42 (upper front portion of the shoe). It may be appreciated however that other wearing apparel 40 such as shirts, pants, hats, gloves, and the like could also be used (refer also to FIG. 14). Member 22 is disposable on the shoe 40 so that member 22 resides surface up on vamp 42 of shoe 40. System 220 further includes a connector 44 for connecting member 22 to article of wearing apparel 40. In the shown embodiment connector 44 is a tie which connects member 22 to article of wearing apparel 40 (to the laces of the shoe). It may be appreciated that other connectors such as clips, clamps, straps, adhesive, hook and loop fasteners, or the like could also be employed to connect member 22 to article of wearing apparel 40.

Figure 14:
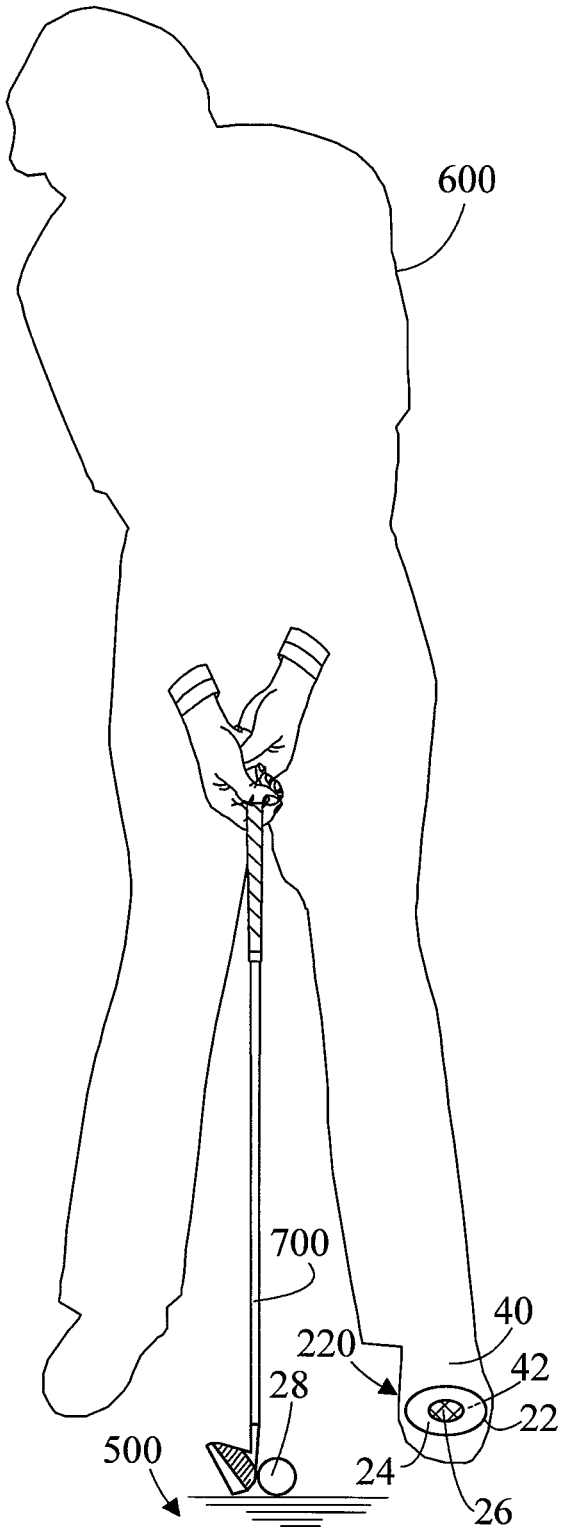
FIG. 14 is a reduced front elevation view of a player using the third embodiment of the system.
Figure 15:
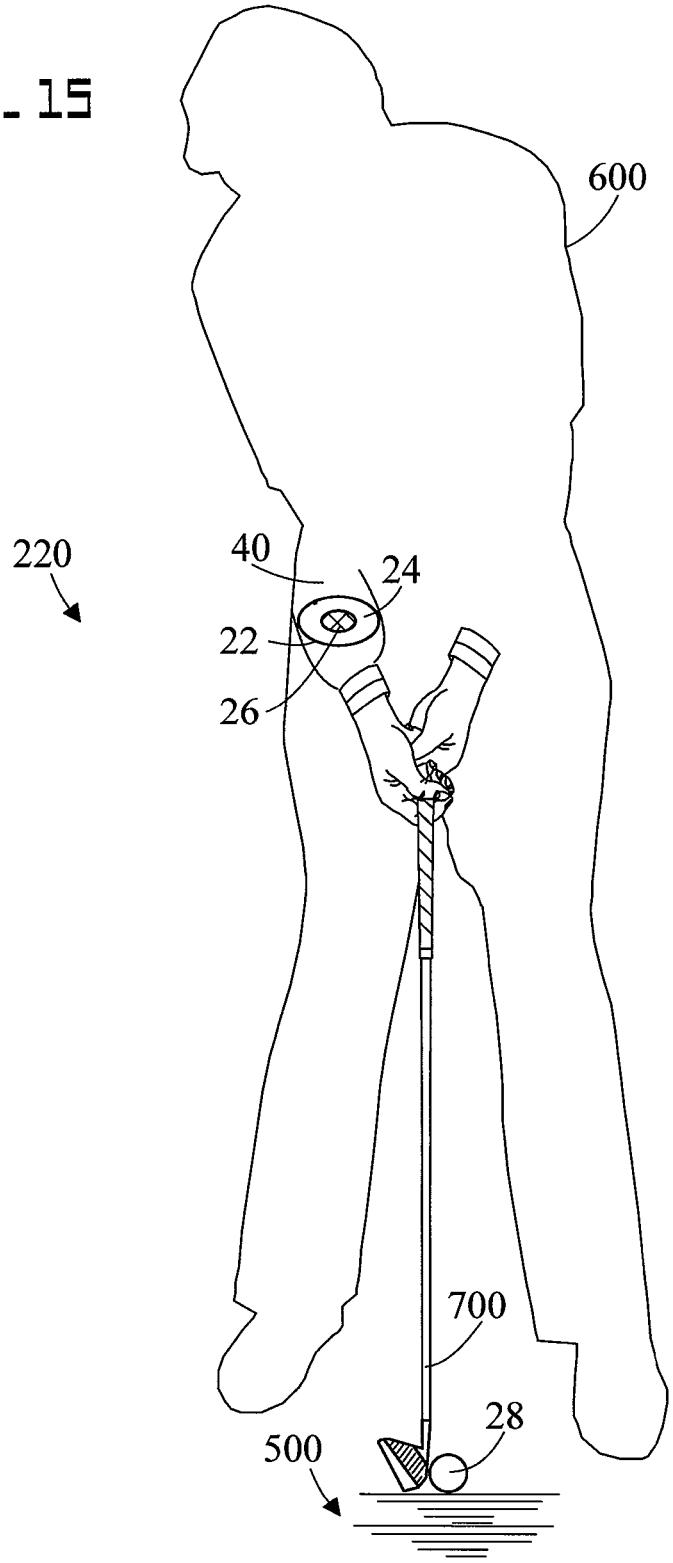
FIG. 15 is reduced front elevation view of a player using another version of the third embodiment.

FIG. 14 is a reduced front elevation view of a player 600 using third embodiment 220, and FIG. 15 is a reduced front elevation view of a player using another version of embodiment 220. Shown are member 22, colored area 26, golf ball 28, article of wearing apparel 40, support surface 500, player 600, and golf club 700. In FIG. 14, member 22 is disposed on the shoe of player 600, and in FIG. 15, member 22 is disposed on the shirt sleeve of player 600. In both cases member 22 is positioned so that colored area 26 can be viewed by player 600.

In terms of using embodiment 220, a method for a player 600 to play golf includes (refer to FIGS. 13-15 and the associated discussions)

(a) providing a support surface 500;

(b) providing a golf club; 700

(c) providing a system 220 for playing golf including;

a member 22 having a surface 24;

a colored area 26 disposed on surface 24 of member 22, colored area 26 being yellow;

a golf ball 28 which is positionable upon support surface 500;

an article of wearing apparel 40 worn by player 600;

(d) causing member 22 to be disposed on article of wearing apparel 40 so that colored area 26 is visible to player 600;

(e) placing golf ball 28 upon support surface 500;

(f) player 600 staring at colored area 26 for a few seconds;

(g) after step (f), player 600 closing his or her eyes and seeing a violet afterimage; and, (h) player 600 opening his or her eyes and using golf club 700 to hit golf ball 32.

The method further including:

in step (c), providing a connector for connecting member 22 to article of wearing apparel 40 in step (d).

The method further including:

prior to step (f), player 600 conditioning his/her vision by staring at colored area 26 for a short period of time every day for a few weeks.

The method further including:

in step (c), article of wearing apparel 40 being a shoe having a vamp 42; and, in step (d), connecting member 22 to vamp 42 of shoe 40 so that surface 24 can be viewed by player 600.

Figure 16:
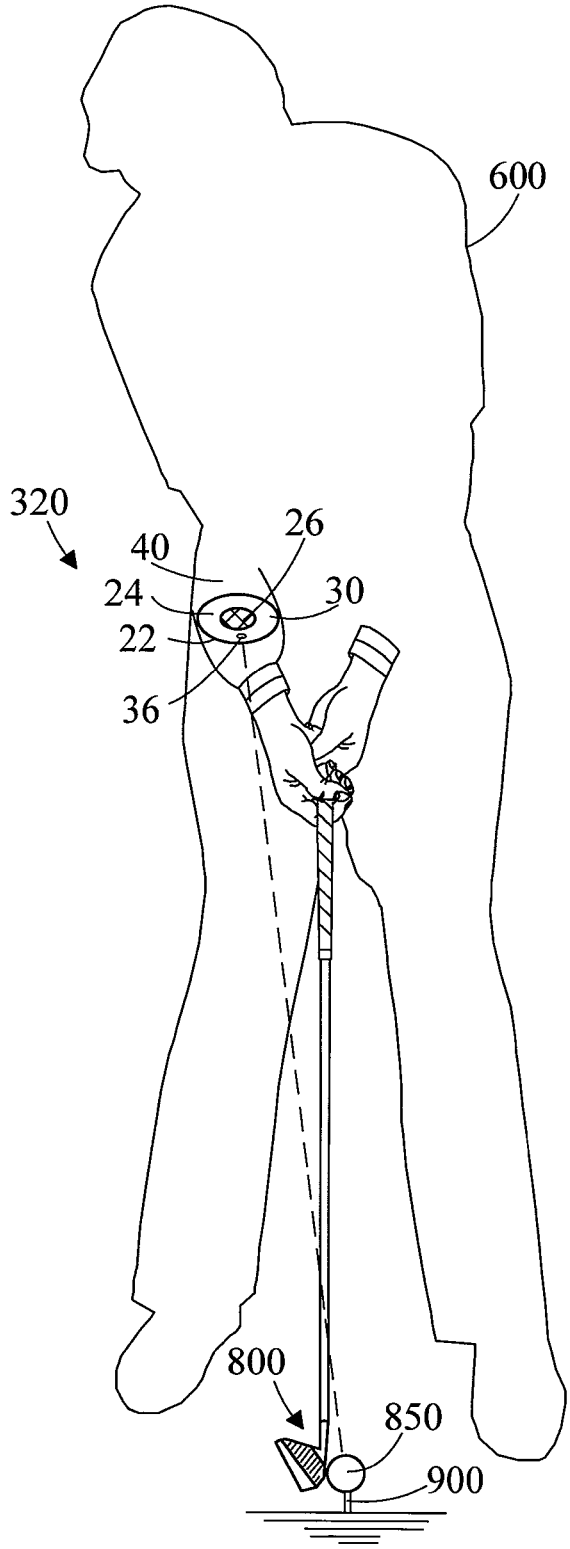
FIG. 16 is a reduced front elevation view of a player using a fourth embodiment of the system.
Figure 17:
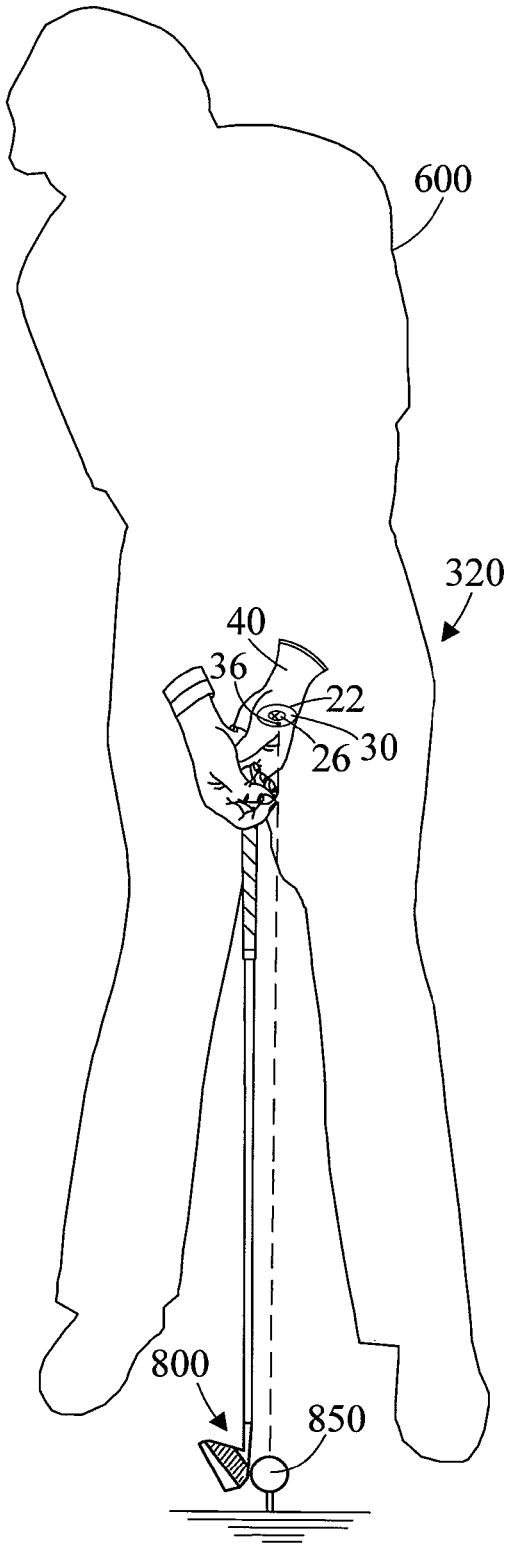
FIG. 17 is another reduced front elevation view of a player using the fourth embodiment of the system.

FIG. 16 is a reduced front elevation view of a player 600 using a fourth embodiment 320 of the system. Fourth embodiment 320 is similar to previously cited embodiments 20, 120, and 220, and includes other features. Referring also to FIGS. 2 and 6, member 22 has a surface 24. A colored area 26 is disposed on surface 24 of member 22, the colored 26 area being yellow. A second area 30 is disposed on surface 24 of member 22 around colored area 26. An article of wearing apparel 40 is worn by the player 600. In the shown embodiment article of wearing apparel 40 is a shirt having a sleeve. However it may be appreciated that article of wearing apparel 40 could be a shoe having a vamp as depicted in FIGS. 13-14 and the associated discussion, a golf glove as shown in FIG. 17, or other article of wearing apparel 40 which is useful in system 320. Member 22 is disposable on article of wearing 40 apparel so that yellow colored area 26 is visible to the player.

The yellow of colored area 26 has a wavelength of about 550 nanometers which produces a violet afterimage having a wavelength of about 400 nanometers. In the shown embodiment second area 30 is white and completely surrounds said colored area 26. Also in the shown embodiment, member 22 is disk shaped, second area 30 is circular, and colored area 26 is circular and centered within second area 30 (refer also to FIG. 2).

System 320 cooperates with (is used in conjunction with) a playing area 800 which includes a golf ball 850 and a golf tee having a shank 900. A hole 36 is disposed in second area 30, hole 36 for receiving shank 900 of the golf tee. Member 22 is disposable on article of wearing apparel 40 so that hole 36 is disposed between colored area 26 and playing area 800 (along the dashed line). In this embodiment, hole 36 serves as a pointer which directs the players 600 attention to playing area 800 and specifically to golf ball 850.

FIG. 17 is another reduced front elevation view of a player 600 using the fourth embodiment 320 of the system. It is noted that in this embodiment, member 22 is sized so that it will fit upon said article of wearing apparel 40. Since the article of wearing apparel is a golf glove 40, member 22, colored area 26, second area 30, and hole 36 have been proportionally reduced in size so they will fit on the glove 40.

Figure 18:
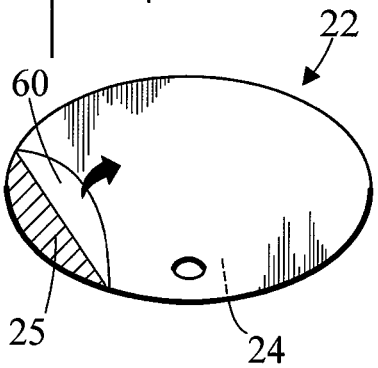
FIG. 18 is a reverse perspective view of a member having adhesive.

As in embodiment 220, a connector is used to connect member 22 to article of wearing apparel 40. The connector can be tie, a clip, a clamp, a strap, hook and loop fasteners, adhesive, sewing, etc. FIG. 18 is a reverse perspective view of member 22 which has a second (back) surface 25 opposite front surface 24 (refer to FIG. 6). An adhesive is disposed on second surface 25, the adhesive for connecting member 40 to article of wearing apparel 40. Release paper 60 covers the adhesive, and is peeled off just prior to use.

Figure 19:
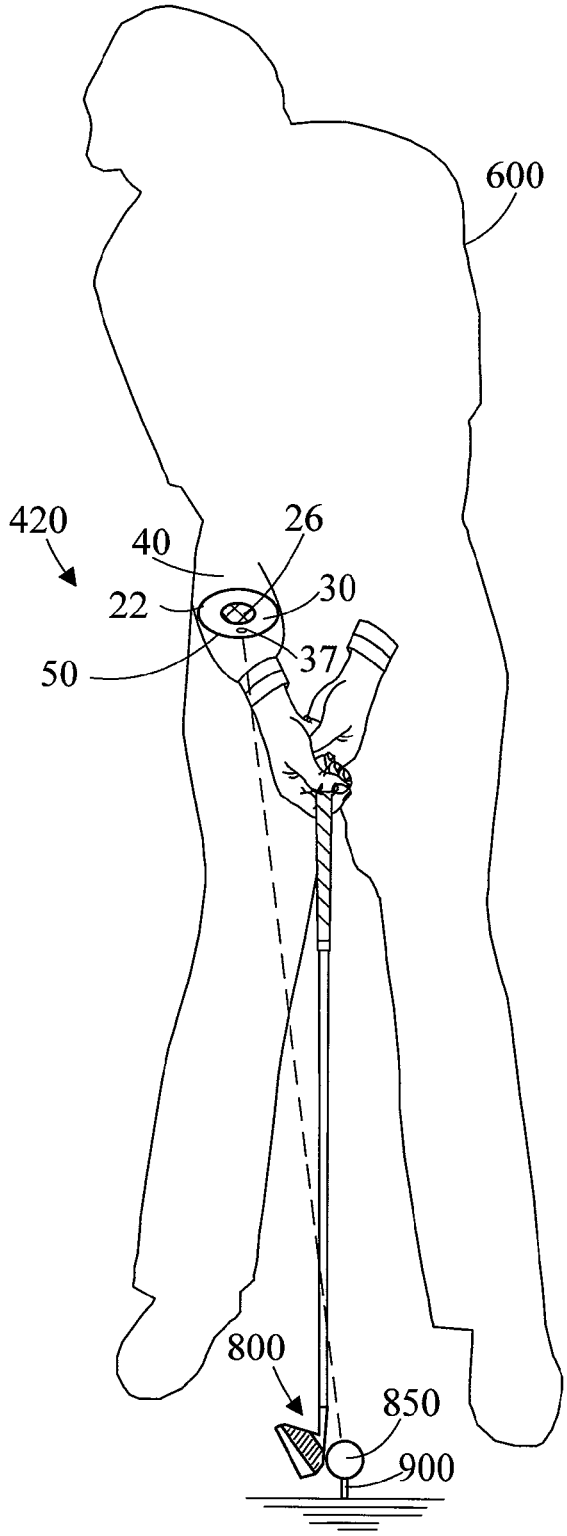
FIG. 19 is a front elevation view of a player using a fifth embodiment of the system.

FIG. 19 is a front elevation view of a player 600 using a fifth embodiment system, generally designated 420. System 420 cooperates with a playing area 800 which includes a golf ball 850 and a golf tee having a shank 900. System 420 includes an article of wearing apparel 40 worn by the player 600. A colored area 26 is disposed on article of wearing apparel 40 so that colored area 26 is visible to the player 600. The colored area 26 is yellow. A second area 30 is disposed around colored area 26. A circle 37 is disposed in second area 30, circle 37 representing a hole for receiving the shank 900 of the golf tee. In this embodiment colored area 26, second area 30, and circle 37 are directly disposed on article of wearing apparel 40 such as by printing, painting, silkscreening, stenciling, or the like. That is, no member 22 is required to carry colored area 26, second area 30, or circle 37.

In an embodiment, a dark border 50 (such as of black, or any other dark color) is disposed around second area 30.

The yellow of colored area 26 has a wavelength of about 550 nanometers which produces a violet afterimage having a wavelength of about 400 nanometers. In the shown embodiment second area 30 is white and completely surrounds said colored area 26. Also in the shown embodiment, member 22 is disk shaped, second area 30 is circular, and colored area 26 is circular and centered within second area 30 (refer also to FIG. 2).

In an embodiment, colored area and circle 37 are disposed so that circle 37 is disposed between colored area 26 and the playing area 800 (along the dashed line). In this embodiment, circle 37 serves a pointer which directs the players 600 attention to playing area 800 and specifically to golf ball 850.

In an embodiment, article of wearing apparel 40 is one of a shoe, a shirt (shown), and a glove. In another embodiment, colored area 26, second area 30, and circle 37 are sized so that they will fit upon article of wearing apparel 40.

The embodiments of the system described herein are exemplary and numerous modifications, combinations, variations, and rearrangements can be readily envisioned to achieve an equivalent result, all of which are intended to be embraced within the scope of the appended claims. Further, nothing in the above-provided discussions of the system should be construed as limiting the invention to a particular embodiment or combination of embodiments. The scope of the invention is defined by the appended claims.

I claim:

1. A system for a player to play golf, the system cooperating with a playing area which includes a golf ball and a golf tee having a shank, the system comprising:
- a member having a surface;
- a colored area disposed on said surface of said member, said colored area being yellow;
- a second area disposed on said surface of said member around said colored area;
- an article of wearing apparel worn by the player;
- said member disposable on said article of wearing apparel so that said colored area is visible to the player;
- a hole disposed in said second area, said hole for receiving the shank of the golf tee; and,
- said member disposable on said article of wearing apparel so that said hole is disposed between said colored area and the playing area.

2. A system for a player to play golf, the system comprising:
- a member having a surface;
- a colored area disposed on said surface of said member, said colored area being yellow;
- a second area disposed on said surface of said member around said colored area;
- an article of wearing apparel worn by the player;
- said member disposable on said article of wearing apparel so that said colored area is visible to the player; and,
- a connector for connecting said member to said article of wearing apparel.

3. The system according to claim 2, further including:
- said member having a second surface opposite said surface; and,
- an adhesive disposed on said second surface, said adhesive for connecting said member to said article of wearing apparel.

4. A system for a player to play golf, the system comprising:
- a member having a surface;
- a colored area disposed on said surface of said member, said colored area being yellow;
- a second area disposed on said surface of said member around said colored area;
- an article of wearing apparel worn by the player;
- said member disposable on said article of wearing apparel so that said colored area is visible to the player;
- said article of wearing apparel being a shoe having a vamp; and,
- said member disposable on said shoe so that said member resides colored area up on said vamp of said shoe.

5. A system for a player to play golf, the system cooperating with a playing area which includes a golf ball and a golf tee having a shank, the system comprising:
- a member having a surface;
- a colored area disposed on said surface of said member, said colored area being yellow;
- a second area disposed on said surface of said member around said colored area;
- an article of wearing apparel worn by the player;
- said member disposable on said article of wearing apparel so that said colored area is visible to the player;
- a hole disposed in said second area, said hole for receiving the shank of the golf tee;
- said member disposable on said article of wearing apparel so that said hole is disposed between said colored area and the playing area;
- said yellow having a wavelength of about 550 nanometers which produces a violet afterimage having a wavelength of about 400 nanometers;
- said second area being white and completely surrounding said colored area;
- said second area being circular;
- said colored area being circular and centered within said second area;
- a connector for connecting said member to said article of wearing apparel; and,
- said member being disk shaped, and said colored area being circular.

6. A system for a player to play golf, the system cooperating with a playing area which includes a golf ball and a golf tee having a shank, the system comprising:
- an article of wearing apparel worn by the player;
- a colored area disposed on said article of wearing apparel so that said colored area is visible to the player, said colored area being yellow;
- a second area disposed around said colored area; and,
- a circle disposed in said second area, said circle representing a hole for receiving the shank of the golf tee.

7. The system according to claim 6, further including:
- said colored area and said circle disposed so that said circle is disposed between said colored area and the playing area.

8. The system according to claim 6, further including:
- a dark border disposed around said second area.

9. The system according to claim 6, further including:
- said yellow having a wavelength of about 550 nanometers which produces a violet afterimage having a wavelength of about 400 nanometers.

10. The system according to claim 6, further including:
- said second area being white and completely surrounding said colored area.

11. The system according to claim 6, further including:
- said member being disk shaped;
- said second area being circular; and,
- said colored area being circular and centered within said second area.

12. The system according to claim 6, further including:
- said article of wearing apparel being one of a shoe, a shirt, and a glove.

13. The system according to claim 6, further including:

said colored area, said second area, and said circle sized so that they will fit upon said article of wearing apparel.

14. The system according to claim 6, further including:

said colored area and said circle disposed so that said circle is disposed between said colored area and the playing area;

a dark border disposed around said second area;

said yellow having a wavelength of about 550 nanometers which produces a violet afterimage having a wavelength of about 400 nanometers;

said second area being white and completely surrounding said colored area;

said member being disk shaped;

said second area being circular;

said colored area being circular and centered within said second area; and, said article of wearing apparel being one of a shoe, a shirt, and a glove.

* * * * *